United States Patent [19]

Ingersoll

[11] Patent Number: 4,563,920

[45] Date of Patent: Jan. 14, 1986

[54] HIGH TORQUE OUTPUT, COLLAPSIBLE AND LIGHT WEIGHT WRENCH

[76] Inventor: Thomas S. Ingersoll, 130 Fountain Ave., Pacific Grove, Calif. 93950

[21] Appl. No.: 605,886

[22] Filed: May 1, 1984

[51] Int. Cl.[4] ..... B25B 13/00

[52] U.S. Cl. ..... 81/177.8; 81/124.7

[58] Field of Search ..... 81/53 R, 121 R, 121 B, 81/119, 177 R, 177 A, 177.8

[56] References Cited

U.S. PATENT DOCUMENTS

| | | | |
|---|---|---|---|
| 2,657,603 | 11/1953 | Evans | 81/119 X |
| 2,875,658 | 3/1959 | Benjamin | 81/53 R X |
| 3,691,877 | 9/1972 | Harris | 81/177 A |
| 3,715,937 | 2/1973 | Cade et al. | 81/177.8 |
| 3,897,702 | 8/1975 | Rovai | 81/119 |

*Primary Examiner*—James G. Smith

[57] ABSTRACT

A high torque output, collapsible and light weight wrench including a head portion with work engaging surfaces and two handle members, one handle member being flexible and of minimum cross sectional area and the other being rigid and composed of two or more component units. All portions, members and units of members of said wrench are loosely removably interconnected such that they remain in assembled relationship when said wrench is in operation, during which time the flexible handle member remains in a state of tension and the rigid handle member remains in a state of compression, such that bending forces are eliminated and lighter material may be used in their construction.

3 Claims, 2 Drawing Figures

HIGH TORQUE OUTPUT, COLLAPSIBLE AND LIGHT WEIGHT WRENCH

This invention relates to wrenches in general and more specifically to a wrench that is collapsible, light in weight and yet capable of high torque output.

One application of the invention to be described herein involves the process of removing the freewheel gear cluster from the rear wheel hub of a bicycle.

A broken rear wheel spoke is one of the more common mechanical mishaps related to bicycling. The impact of a broken spoke is disruption of wheel-true, and hence, rim contact with the brake pads. If riding is continued after a spoke is broken, especially in an area of steep terrain, other spokes may be overstressed to the point of failure. Adjusting the brake pads away from an out-of-true rim adversely affects braking capacity.

Almost invariably, spoke breakage occurs on the freewheel side of the rear wheel hub. This necessitates removal of the freewheel gear cluster in order to replace the spoke.

The freewheel gear cluster is threadably attached to the rear wheel hub. During an in-shop repair, the freewheel gear cluster is removed by first inserting a two-pronged or splined removing tool into the freewheel body. A wrench is then applied to the removing tool; sufficient leverage is applied to the wrench and the freewheel is rotatably removed from the wheel hub. The wrench so applied is most commonly a twelve inch crescent wrench. Also, the freewheel removing tool may be placed in a bench vise and the wheel rim used as the leveraging device.

In a roadside repair situation several options are available. A freewheel removing tool is carried in the bike's tool bag. Since it is impractical to carry a twelve inch crescent wrench, the cyclist must rely on being able to borrow a wrench. If the breakage occurs in an area remote from habitation, this becomes a disadvantage.

Filed flange and "Z" spokes have a modified flange end that can be inserted into the wheel hub flange without removing the freewheel gear cluster. At best, either of these is a very temporary remedy. The filed flange can become disengaged through tension-compression flexation action. Neither spoke modification can be engaged into the wheel hub flange when a rear chain guard is used or when spoke breakage occurs in the spoke's shank portion.

A relatively new invention, the "Pocket Vise," is a practical device available for roadside freewheel gear cluster removal. It is a compact, lightweight, U-shaped tool with work engaging surfaces on one end to engage the flats of the freewheel removing tool and stud-like projections on the opposite end to receive a leveraging device. A disadvantage of this tool is that a leveraging device, such as a road sign, may not be available. In cases like this, the bike's handle bar stem may be used. Disadvantages of this application are marring of the handle bar stem and possible twisting of the stem in the head tube resulting in misalignment of handle bars and front wheel.

Accordingly, an object of this invention is to provide a wrench suitable for freewheel gear cluster removal in a roadside repair situation that overcomes the disadvantages of the prior art. This wrench is light in weight and collapsible. It can be applied when a rear wheel chain guard is used and includes its own leveraging handle.

A further object of the invention is to provide a collapsible wrench that, when assembled, is of sufficient dimension to turn a large, high-torque nut and that, when disassembled, will fit into a standard size tool box. An example of such an application is when, in a roadside repair situation, one of the various large, high-torque nuts in an automobile must be removed and/or installed.

Heretofore, this operation was completed by applying the proper size socket to the nut, attaching a breaker bar to the socket and then applying the additional leveraging force by means of a galvanized pipe extension. Carrying a three foot length of pipe in one's car is cumbersome. Also, as a consequence of the additional leverage applied, the stress tolerances of the breaker bar are pushed to near or sometimes over the point of failure.

DRAWINGS

DESCRIPTION

Figure 1:
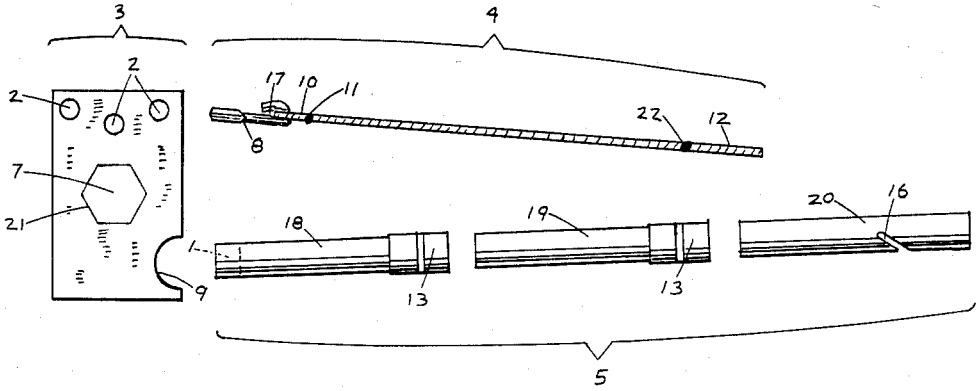
FIG. 1 is a side-elevational, exploded view illustrating the preferred embodiment of the invention herein described.
Figure 2:
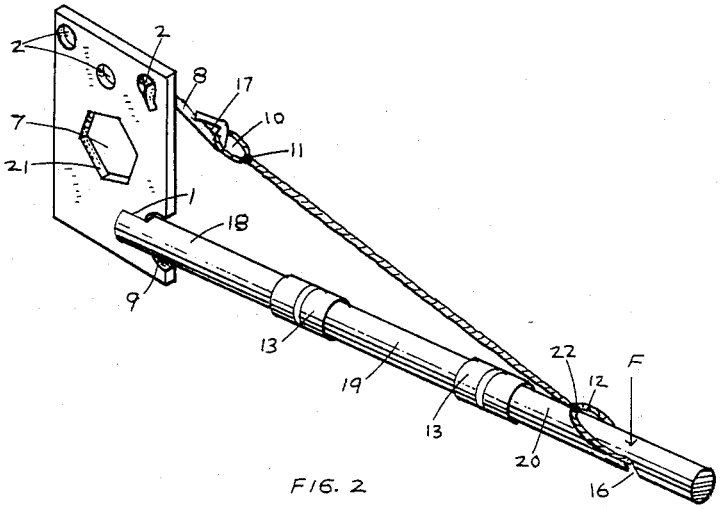
FIG. 2 is a perspective view of the tool shown in FIG. 1.

Accordingly, a preferred embodiment of the invention is shown in FIGS. 1 and 2. The wrench consists of a head portion, generally designated 3, and a handle portion composed of two principal members, a first handle member generally designated 4, and a second handle member generally designated 5.

The head portion 3 may be fabricated from any substantially rigid material of suitable gauge, such as, case-hardened steel. The first handle member 4 may be fabricated from any flexible material that has suitable strength in tension, such as, cord or braided wire. Relatively small gauge, rigid material in chain form may also be used. The second handle member 5 should be fabricated from any substantially rigid material that is relatively light and has suitable strength in compression, such as, hard-drawn copper tube.

The head portion 3 is substantially rectangular in outline as viewed in elevation. The primary feature of the head portion 3 is a central bore 7, positioned intermediate to the sides and whose central axis is normal to the rectangular plane surface of the head portion 3. The central bore 7 is sized and has proper work engaging surfaces 21 to snugly engage the flats of the nut, bolt or freewheel gear cluster removing tool that is to be turned. Another feature of the head portion 3 is two or more bores 2, substantially circular in outline and whose central axes are normal to, and located in the upper portion of, the rectangular plane surface of the head portion 3. The bores 2 are sized to receive the hook 8 of the first handle member 4. Still another feature of the head portion 3 is a recess 9 located below the central bore 7. The recess 9 is suitably sized for mating with the mortise 1 located in the second handle member 5.

Proximate and remote ends of the first handle member 4 with respect to the head portion 3 are designated for orientation purposes.

The proximate end of the first handle member 4 terminates with a hook 8, the proximate portion of which is of suitable configuration and cross section to be loosely removably disposed within one of the bores 2. The eye portion 17 of the hook 8 permanently receives the loop 10 which is of suitable dimension to be received therein. The loop 10 is secured as such by a knot or weld 11. The remote portion of the first handle member 4 is composed of a loop 12 of sufficient dimension such that a transverse section of the second handle member 5 will pass through it. The loop 12 is secured as such by a knot or weld 22.

Proximate and remote ends of the second handle member 5 with respect to the head portion 3 are designated for orientation purposes.

The second handle member 5 is substantially circular in cross section and is composed of two or more units, a proximate second handle member unit 18, electively one or more intermediate second handle member units 19, and a remote second handle member unit 20. The proximate second handle member unit 18 and all intermediate second handle member units 19 are each fitted with a union 13 that is permanently attached to its remote end. The union 13 of a proximately positioned second handle member unit removably receives the proximate end of a more remote second handle member unit.

A mortise 1 is located at the proximate end of the proximate second handle member unit 18 and is of sufficient dimension and depth to be snugly removably receivable within the recess 9 in the head portion 3.

The remote end of the remote second handle member unit 20 contains an inwardly or proximately projecting slot 16. The slot is of suitable dimension and attitude to capture and hold the loop 12 of the first handle member 4.

OPERATION

The tool is stored or transported in a collapsed or disassembled state as illustrated in FIG. 1. The first handle member 4 may be coiled so as to occupy an area of similar dimension as the head portion 3.

The disassembled members shown in FIG. 1 are illustrated in an assembled relationship in FIG. 2.

To assemble the component members and portions, the proximate portion of the hook 8 of the first handle member 4 is removably disposed within one of the bores 2 of the head portion 3.

The proximate ends of second handle member units 19 and 20 of the second handle member 5 are removably slideably disposed within the union 13 of a proximately positioned second handle member unit.

The mortise 1 at the proximate end of the second handle member 5 is removably disposed within the recess 9 of the head portion 3.

Finally, the loop 12 of the first handle member 4 is removably disposed within the slot 16 at the remote end of the second handle member 5.

The tool is temporarily retained in assembled relationship by first grasping the head portion 3 with the fingers of one hand and then grasping the remote end of the second handle member 5 with the other hand and applying a slight force in the direction indicated by arrow F in FIG. 2.

If the angular relationships between members and portions of the tool do not approximately resemble the angular relationships as illustrated in FIGS. 1 and 2, at this point or when the tool is performing work, the hook 8 of the first handle member 4 is disposed within another bore 2 of the head portion 3.

In general, the described wrench functions on the truss principle. The flats of the nut, bolt or freewheel removing tool are engaged by the flats 21 in the bore 7 of the head portion 3. A force is applied by the heal of the hand or in some cases by the foot of the user to the remote end of the second handle member 5 in the direction of and in the vicinity of the arrow F as shown in FIG. 2.

The hook 8 of the first handle member 4 is freely movable within a bore 2 of the head portion 3; the loop 12 of the first handle member 4 is freely movable within the slot 16 of the second handle member 5; and, the proximate end of the second handle member 5 is freely pivotal within the recess 9 of the head portion 3. In that all of the above-mentioned attachments are freely movable they are, in a generalized structural sense, pinor hinge-jointed, and the wrench becomes a truss. When a force is applied to the second handle member 5 in the direction and vicinity of arrow F, the first handle member 4 enters a state of tension and as a tie of the truss resists that tensile force. The second handle member 5 enters a state of compression, and as a strut, resists that compressive force.

The attachments between and the forces occurring within the head portion 3, the first handle member 4 and the second handle member 5 are such that when the assembled wrench engages the flats of a sufficiently torqued device that is to be turned, and when a force is then applied to the second handle member 5 in the vicinity and direction of arrow F, biasing forces occur that urge the portions, members and components of members together such that they remain in assembled form throughout the working operation.

It is to be understood that the foregoing description is limited to a preferred physical embodiment and one specific, practical application of the invention. It is not the intention of this description to limit the structural details or potential uses of the invention as such and, accordingly, the scope of the invention is defined by the appended claims and their legal equivalents.

What is claimed is:

1. A high torque output, collapsible and light weight wrench comprising:

a head portion having work engaging surfaces, first handle attaching means consisting of two or more bores located a suitable distance above said work engaging surfaces and second handle attaching means consisting of a recess located a suitable distance below said work engaging surfaces;

a first handle member being flexible and elongated and having a first end portion including first end portion attaching means consisting of a hook and a further end portion including further end portion attachment means consisting of a fixed loop;

a second handle member composed of two or more removably attached units, being rigid and elongated and having a first end portion including first end portion attaching means consisting of a mortise and a further end portion including further end portion attaching means consisting of a slot.

2. The wrench of claim 1 wherein said first end portion attaching means of said first handle member is removably attached to said first handle attaching means of said head portion and said further end portion attaching means of said first handle member is removably attached to said further end portion attaching means of said second handle member and said first end portion attaching means of said second handle member is removably attached to said second handle attaching means of said head portion.

3. The wrench of claim 2 wherein said removable attachments between said handle members and between said handle members and said head portion are all freely moving hinge-type joints.

* * * * *